US009185500B2

(12) United States Patent
Strelcyk et al.

(10) Patent No.: US 9,185,500 B2
(45) **Date of Patent: *Nov. 10, 2015**

(54) COMPRESSION OF SPACED SOURCES FOR HEARING ASSISTANCE DEVICES

(75) Inventors: Olaf Strelcyk, Oakland, CA (US); Brent Edwards, San Francisco, CA (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 520 days.

This patent is subject to a terminal disclaimer.

(21) Appl. No.: 13/568,618

(22) Filed: Aug. 7, 2012

(65) Prior Publication Data

US 2013/0148813 A1 Jun. 13, 2013

Related U.S. Application Data

(63) Continuation-in-part of application No. 12/474,881, filed on May 29, 2009, now Pat. No. 8,705,751.

(60) Provisional application No. 61/058,101, filed on Jun. 2, 2008.

(51) Int. Cl.

| | |
|---|---|
| ***H04R 5/02*** | (2006.01) |
| ***H04R 25/00*** | (2006.01) |
| *H04S 1/00* | (2006.01) |

(52) U.S. Cl.

CPC ..... *H04R 25/50* (2013.01); *H04R 25/356* (2013.01); *H04R 25/552* (2013.01); *H04S 1/005* (2013.01); *H04S 2420/01* (2013.01)

(58) Field of Classification Search

CPC .... H04R 25/50; H04R 25/356; H04R 25/552; H04S 2420/01; H04S 1/005

USPC ..... 381/309, 23.1, 312

See application file for complete search history.

(56) References Cited

U.S. PATENT DOCUMENTS

| | | | |
|---|---|---|---|
| 4,406,001 | A | 9/1983 | Klasco et al. |
| 4,996,712 | A | 2/1991 | Laurence et al. |
| 5,785,661 | A | 7/1998 | Shennib |

(Continued)

FOREIGN PATENT DOCUMENTS

| | | |
|---|---|---|
| DE | 102006047983 | 4/2008 |
| DE | 102006047986 | 4/2008 |

(Continued)

OTHER PUBLICATIONS

"Aphex Systems", Wikipedia, [Online]. Retrieved from the Internet [Archived Nov. 28, 2011]: <URL: http://en.wikipedia.org/w/index.php?title=Aphex_Systems&direction=prev&oldid=490050016>, (Accessed Dec. 30, 2011), 3 pgs.

(Continued)

*Primary Examiner* — Paul S Kim

(74) *Attorney, Agent, or Firm* — Schwegman Lundberg & Woessner, P.A.

(57) ABSTRACT

This application relates to a system for compression and mixing for hearing assistance devices by application of compression to individual sound sources before applying a head-related transfer function (HRTF) to prevent compression and cross modulation of interaural-level-difference (ILD) cues for localization, according to one example. Variations of the present system use coordinated compression to left and right individual source signals after application of HRTFs.

20 Claims, 11 Drawing Sheets

(56) References Cited

U.S. PATENT DOCUMENTS

| | | | | |
|---|---|---|---|---|
| 5,825,894 | A | 10/1998 | Shennib | |
| 6,405,163 | B1 | 6/2002 | Laroche | |
| 6,424,721 | B1 | 7/2002 | Hohn | |
| 7,280,664 | B2 | 10/2007 | Fosgate et al. | |
| 7,330,556 | B2 | 2/2008 | Kates | |
| 7,340,062 | B2 | 3/2008 | Revit et al. | |
| 7,409,068 | B2 * | 8/2008 | Ryan et al. | 381/313 |
| 8,521,530 | B1 | 8/2013 | Every et al. | |
| 8,705,751 | B2 | 4/2014 | Edwards | |
| 9,031,242 | B2 | 5/2015 | Edwards et al. | |
| 2001/0040969 | A1 | 11/2001 | Revit et al. | |
| 2002/0078817 | A1 | 6/2002 | Date | |
| 2003/0169891 | A1 | 9/2003 | Ryan et al. | |
| 2004/0190734 | A1 | 9/2004 | Kates | |
| 2005/0135643 | A1 | 6/2005 | Lee et al. | |
| 2006/0034361 | A1 | 2/2006 | Choi | |
| 2006/0050909 | A1 | 3/2006 | Kim et al. | |
| 2006/0083394 | A1 | 4/2006 | McGrath | |
| 2007/0076902 | A1 | 4/2007 | Master | |
| 2007/0297626 | A1 | 12/2007 | Revit et al. | |
| 2008/0044048 | A1 | 2/2008 | Pentland | |
| 2008/0205664 | A1 | 8/2008 | Kim et al. | |
| 2009/0043591 | A1 | 2/2009 | Breebaart | |
| 2009/0116657 | A1 | 5/2009 | Edwards et al. | |
| 2009/0296944 | A1 * | 12/2009 | Edwards | 381/23.1 |
| 2010/0040135 | A1 | 2/2010 | Yoon et al. | |
| 2010/0211388 | A1 | 8/2010 | Yu et al. | |
| 2011/0046948 | A1 | 2/2011 | Pedersen | |
| 2011/0286618 | A1 | 11/2011 | Vandali et al. | |
| 2013/0051565 | A1 | 2/2013 | Pontoppidan | |
| 2013/0108096 | A1 | 5/2013 | Fitz | |
| 2013/0163784 | A1 | 6/2013 | Tracey et al. | |
| 2013/0182875 | A1 | 7/2013 | Cederberg et al. | |
| 2014/0226825 | A1 | 8/2014 | Edwards | |
| 2015/0092967 | A1 | 4/2015 | Fitz et al. | |

FOREIGN PATENT DOCUMENTS

| | | | |
|---|---|---|---|
| EP | 1531650 | | 5/2005 |
| EP | 1655998 | | 5/2006 |
| EP | 1796427 | | 6/2007 |
| EP | 1895515 | | 3/2008 |
| EP | 2131610 | A1 | 12/2009 |
| EP | 1236377 | | 11/2011 |
| EP | 2191466 | B1 | 5/2013 |
| WO | WO-0124577 | | 4/2001 |
| WO | WO-0176321 | | 10/2001 |
| WO | WO-2007041231 | | 4/2007 |
| WO | WO-2007096808 | | 8/2007 |
| WO | WO-2007106553 | | 9/2007 |
| WO | WO-2009035614 | A1 | 3/2009 |
| WO | WO-2011100802 | A1 | 8/2011 |

OTHER PUBLICATIONS

"U.S. Appl. No. 11/935,935 , Response filed Jun. 5, 2013 to Final Office Action mailed Dec. 6, 2012", 14 pgs.
"U.S. Appl. No. 11/935,935, Examiner Interview Summary mailed Apr. 12, 2013", 3 pgs.
"U.S. Appl. No. 11/935,935, Final Office Action mailed Dec. 6, 2012", 10 pgs.
"U.S. Appl. No. 11/935,935, Non Final Office Action mailed Jul. 17, 2013", 17 pgs.
"U.S. Appl. No. 11/935,935, Response filed Nov. 5, 2012 to Non Final Office Action mailed Jul. 5, 2012", 13 pgs.
"U.S. Appl. No. 12/474,881, Notice of Allowance mailed Sep. 4, 2013", 9 pgs.
"U.S. Appl. No. 12/474,881, Response filed Jun. 13, 2012 to Non Final Office Action mailed Jan. 13, 2012", 8 pgs.
"U.S. Appl. No. 12/474,881, Response filed Dec. 20, 2012 to Final Office Action mailed Jun. 21, 2012", 6 pgs.
"European Application Serial No. 09161628.4, Communication of Notice of Opposition mailed May 23, 2011", 15 pgs.
"European Application Serial No. 09161628.4, Letter from the Opponent mailed Sep. 16, 2013", 6 pgs.
"European Application Serial No. 09161628.4, Response filed Jan. 6, 2012 to Notice of Opposition mailed Jun. 21, 2011", 14 pgs.
"European Application Serial No. 09161628.4, Response filed Sep. 16, 2013 to Summons to Attend Oral Proceedings mailed Mar. 7, 2013", 48 pgs.
"European Application Serial No. 09161628.4, Summons to Attend Oral Proceedings mailed Mar. 7, 2013", 13 pgs.
Hu, Yi, et al., "A comparative intelligibility study of single-microphone noise reduction algorithms", J Acoust Soc Am., 122(3), (2007), 1777-1786.
Hu, Yi, et al., "Techniques for estimating the ideal binary mask", Proc. of 11th International Workshop on Acoustic Echo and Noise Control, [Online]. Retrieved from the Internet: <URL: http://www.iwaenc.org/proceedings/2008/contents/papers/9029.pdf>, (2008), 4 pgs.
Larsen, Erik, et al., "Perceiving Low Pitch through Small Loudspeakers", Presented at the AES 108th Convention, (Feb. 2000), 1-21.
Loizou, P C, et al., "Reasons why Current Speech-Enhancement Algorithms do not Improve Speech Intelligibility and Suggested Solutions", IEEE Transactions on Audio, Speech, and Language Processing, vol. 19, No. 1, (Jan. 2011), 47-56.
"U.S. Appl. No. 11/935,935, Advisory Action mailed May 14, 2014", 3 pgs.
"U.S. Appl. No. 11/935,935, Decision on Pre-Appeal Brief Request mailed Jul. 21, 2014", 3 pgs.
"U.S. Appl. No. 11/935,935, Pre-Appeal Brief filed Jun. 2, 2014", 5 pgs.
"U.S. Appl. No. 11/935,935, Response filed May 2, 2014 to Final Office Action mailed Jan. 2, 2014", 16 pgs.
"European Application Serial No. 08253607.9, Response filed May 14, 2014 to Office Action mailed Jan. 14, 2014", 16 pgs.
"European Application Serial No. 09161628.4, Office Action mailed Mar. 26, 2013", 10 pgs.
"European Application Serial No. 09161628.4, Reply to Appeal filed Aug. 11, 2014", 69 pgs.
"European Application Serial No. 13198739.8, Extended European Search Report mailed Mar. 27, 2014", 5 pgs.
Bochler, M, et al., "Sound classification in hearing aids inspired by auditory scene", Eurasip Journal of Applied Signal, Processing, Hindawi Publishing Co., Cuyahoga Falls, OH, US, vol. 2005, No. 18, (Oct. 15, 2005), 2991-3002.
Robjohns, Hugh, "How & When to Use Mixed Compression", Sound on Sound, [Online]. Retrieved from the Internet: <URL:http://www.soundonsound.com/sos/Jun99/articles/mIxcomp.htm>, (Jun. 1999), 11 pgs.
"U.S. Appl. No. 11/935,935, Final Office Action mailed Jan. 2, 2014", 17 pgs.
"U.S. Appl. No. 11/935,935, Response filed Nov. 18, 2013 to Non Final Office Action mailed Jul. 17, 2013", 15 pgs.
"U.S. Appl. No. 12/474,881, Notice of Allowance mailed Nov. 15, 2013", 7 pgs.
"European Application Serial No. 08253607.9, Office Action mailed Jan. 14, 2014", 6 pgs.
"European Application Serial No. 09161628.4, Communication of Further Notices of Opposition mailed Jun. 27, 2011", 2 pgs.
"European Application Serial No. 09161628.4, Decision Rejecting the Opposition mailed Nov. 21, 2013", 22 pgs.
"European Application Serial No. 09161628.4, Letter Regarding the Opposition filed Jun. 26, 2012", 6 pgs.
"U.S. Appl. No. 11/935,935, Advisory Action mailed May 23, 2012", 3 pgs.
"U.S. Appl. No. 11/935,935, Final Office Action Mailed Jan. 31, 2012", 10 pgs.
"U.S. Appl. No. 11/935,935, Non Final Office Action mailed Jun. 27, 2011", 9 pgs.
"U.S. Appl. No. 11/935,935, Non Final Office Action mailed Jul. 5, 2012", 11 pgs.
"U.S. Appl. No. 11/935,935, Response filed Apr. 30, 2012 to Final Office Action mailed Jan. 31, 2012", 10 pgs.

(56) References Cited

OTHER PUBLICATIONS

"U.S. Appl. No. 11/935,935, Response filed May 31, 2012 to Final Office Action mailed Jan. 31, 2012 and Advisory Action mailed May 23, 2012", 11 pgs.
"U.S. Appl. No. 11/935,935, Response filed Oct. 27, 2011 to Non Final Office Action mailed Jun. 27, 2011", 8 pgs.
"U.S. Appl. No. 12/474,881, Final Office Action mailed Jun. 21, 2012", 9 pgs.
"U.S. Appl. No. 12/474,881, Non Final Office Action Mailed Jan. 13, 2012", 11 pgs.
"U.S. Appl. No. 12/474,881, Response filed Dec. 30, 2011 to Restriction Requirement mailed Nov. 30, 2011", 7 pgs.
"U.S. Appl. No. 12/474,881, Restriction Requirement mailed Nov. 30, 2011", 7 pgs.
"European Application Serial No. 08253607.9, Office Action mailed Mar. 19, 2010", 1 pg.
"European Application Serial No. 08253607.9, Office Action Response Filed Sep. 22, 2010", 12 pgs.
"European Application Serial No. 08253607.9, Office Action Response filed Nov. 16, 2011", 11 pgs.
"European Application Serial No. 08253607.9, Search Report mailed Aug. 11, 2009", 9 pgs.
"European Application Serial No. 08253607.9; Office Action mailed May 9, 2011", 9 Pgs.
"European Application Serial No. 09161628.4, Communication of a Notice of Opposition mailed May 23, 2011", 15 pgs.
"European Application Serial No. 09161628.4, European Search Report mailed Jul. 29, 2009", 3 pgs.
"European Application Serial No. 09161628.4, Extended European Search Report mailed Aug. 5, 2009", 4 pgs.
"European Application Serial No. 09161628.4, Response filed Feb. 11, 2010 to European Search Report mailed Aug. 5, 2009", 3 pgs.
Stone, Michael A., et al., "Effects of spectro-temporal modulation changes produced by multi-channel compression on intelligibility in a competing-speech task.", J Acoust Soc Am., 123(2), (Feb. 2008), 1063-76.
"U.S. Appl. No. 11/935,935, Appeal Brief filed Aug. 21, 2014", 25 pgs.
"U.S. Appl. No. 11/935,935, Corrected Notice of Allowance mailed Feb. 5, 2015", 2 pgs.
"U.S. Appl. No. 11/935,935, Notice of Allowance mailed Dec. 26, 2014", 11 pgs.
"U.S. Appl. No. 13/725,443, Non Final Office Action mailed Mar. 23, 2015", 11 pgs.
"U.S. Appl. No. 13/725,443, Response filed Nov. 21, 2014 to Restriction Requirement mailed Aug. 29, 2014", 6 pgs.
"U.S. Appl. No. 13/725,443, Restriction Requirement mailed Aug. 29, 2014", 7 pgs.
"U.S. Appl. No. 14/255,753, Preliminary Amendment filed Aug. 26, 2014", 7 pgs.
"European Application Serial No. 13178787.1, Extended European Search Report mailed Feb. 5, 2015", 7 pgs.
"European Application Serial No. 13198739.8, Response filed May 1, 2015 to Extended European Search Report mailed Mar. 27, 2014", 10 pgs.
"European Application Serial No. 14186975.0, Extended European Search Report mailed Jan. 30, 2015", 9 pgs.
Hu, Yi, "A simulation study of harmonics regeneration in noise reduction for electric and acoustic stimulation", The Journal of the Acoustical Society of America, American Institute of Physics for the Acoustical Society of America, New York, NY, US, vol. 127, No. 5, (May 1, 2010), 3145-3153.
Sinex, Donal G, "Recognition of speech in noise after application of time-frequency masks: Dependence on frequency and threshold parameters", The Journal of the Acoustical Society of America, American Institute of Physics for the Acoustical Society of America, New York, NY, US, vol. 133, No. 4, (Apr. 1, 2013).
"U.S. Appl. No. 11/935,935, PTO Response to Rule 312 Communication mailed Apr. 8, 2015", 2 pgs.
"U.S. Appl. No. 14/043,320, Non Final Office Action mailed Jun. 11, 2015", 13 pgs.

* cited by examiner

COMPRESSION OF SPACED SOURCES FOR HEARING ASSISTANCE DEVICES

CLAIM OF PRIORITY

The present application is a continuation-in-part (CIP) of and claims the benefit of priority under 35 U.S.C. §120 to U.S. application Ser. No. 12/474,881, filed May 29, 2009, and titled COMPRESSION AND MIXING FOR HEARING ASSISTANCE DEVICES, which claims the benefit of priority under 35 U.S.C. §119(e) to U.S. Provisional Patent Application Serial No. 61/058,101, filed on Jun. 2, 2008, the benefit of priority of each of which is claimed hereby, and each of which are incorporated by reference herein in its entirety

FIELD OF THE INVENTION

This patent application pertains to apparatus and processes for compression of spaced sources for hearing assistance devices.

BACKGROUND

Hearing assistance devices, such as hearing aids, include electronic instruments worn in or around the ear that compensate for hearing losses by amplifying and processing sound. The electronic circuitry of the device is contained within a housing that is commonly either placed in the external ear canal and/or behind the ear. Transducers for converting sound to an electrical signal and vice-versa may be integrated into the housing or external to it.

Whether due to a conduction deficit or sensorineural damage, hearing loss in most patients occurs non-uniformly over the audio frequency range, most commonly at high frequencies. Hearing aids may be designed to compensate for such hearing deficits by amplifying received sound in a frequency-specific manner, thus acting as a kind of acoustic equalizer that compensates for the abnormal frequency response of the impaired ear. Adjusting a hearing aid's frequency specific amplification characteristics to achieve a desired level of compensation for an individual patient is referred to as fitting the hearing aid. One common way of fitting a hearing aid is to measure hearing loss, apply a fitting algorithm, and fine-tune the hearing aid parameters.

Hearing assistance devices also use a dynamic range adjustment, called dynamic range compression, which controls the level of sound sent to the ear of the patient to normalize the loudness of sound in specific frequency regions. The gain that is provided at a given frequency is controlled by the level of sound in that frequency region (the amount of frequency specificity is determined by the filters in the multiband compression design). When properly used, compression adjusts the level of a sound at a given frequency such that its loudness is similar to that for a normal hearing person without a hearing aid. There are other fitting philosophies, but they all prescribe a certain gain for a certain input level at each frequency. It is well known that the application of the prescribed gain for a given input level is affected by time constants of the compressor. What is less well understood is that the prescription can break down when there are two or more simultaneous sounds in the same frequency region. The two sounds may be at two different levels, and therefore each should receive different gain for each to be perceived at their own necessary loudness. Because only one gain value can be prescribed by the hearing aid, however, at most one sound can receive the appropriate gain, providing the second sound with the less than desired sound level and resulting loudness.

This phenomenon is illustrated in the following figures. FIG. 1 shows the levels of two different sounds out of a filter centered at 1 kHz—in this example, the two sounds are two different speech samples. The samples are overlaid on FIG. 1 and one is in a thick dark line 1 and the second is in a thin line 2.

FIG. 2 shows the gains that would be applied to those two different sounds at 1 kHz if they were to be presented to a hypothetical multiband dynamic range compressor. Notice that the ideal gain for each speech sample is different. Again, the samples from the thick dark line 1 are shown in comparison to those of the thin line 2.

FIG. 3 shows the two gains from FIG. 1 represented by the thick dark line 1 and the thin line 2, but with a line of intermediate thickness 3 which shows the gain that is applied when the two sounds are mixed together before being sent to the multiband compressor. Notice that when the two sounds are mixed together, neither receives the exact gain that should be prescribed for each separately; in fact, there are times when the gain should be high for one speech sample, but it is low because the gain is controlled by the level of the mix of the two sounds, not the level of each sound individually. This can cause artificial envelope fluctuations in each sound, described as comodulation or cross modulation by Stone and Moore (Stone, M. A., and Moore, B. C. (2008). "Effects of spectro-temporal modulation changes produced by multi-channel compression on intelligibility in a competing-speech task," J Acoust Soc Am 123, 1063-1076.)

This could be particularly problematic with music and other acoustic sound mixes such as the soundtrack to a Dolby 5.1 movie, where signals of significantly different levels are mixed together with the goal of provided a specific aural experience. If the mix is sent to a compressor and improper gains are applied to the different sounds, then the auditory experience is negatively affected and is not the experience intended by the produce of the sound. In the case of music, the gain for each musical instrument is not correct, and the gain to one instrument might be quite different than it would be if the instrument were played in isolation. The impact is three-fold: the loudness of that instrument is not normal for the hearing aid listener (it may be too soft, for example), distortion to the temporal envelope of that instrument can occur, and interaural-level difference (ILD) cues for sound source localization and segregation can be distorted, making the perceived auditory image of that instrument fluctuate in a way that was not in the original recording.

Another example is when the accompanying instrumental tracks in a movie soundtrack have substantial energy then compression can overly reduce the overall level and distort the ILD of the simultaneous vocal tracks, diminishing the ability of the wearer to enjoy the mix of instrumental and vocal sound and even to hear and understand the vocal track. Thus, there is a need in the art for improved compression and mixing systems for hearing assistance devices.

SUMMARY

This application relates to a system for compression for hearing assistance devices by application of compression to individual sound sources before applying a head-related transfer function (HRTF) to prevent compression and cross modulation of ILD cues for localization, according to one example. Variations of the present system use coordinated compression to left and right individual source signals after application of HRTFs. This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their legal equivalents.

DETAILED DESCRIPTION

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

Figure 1:
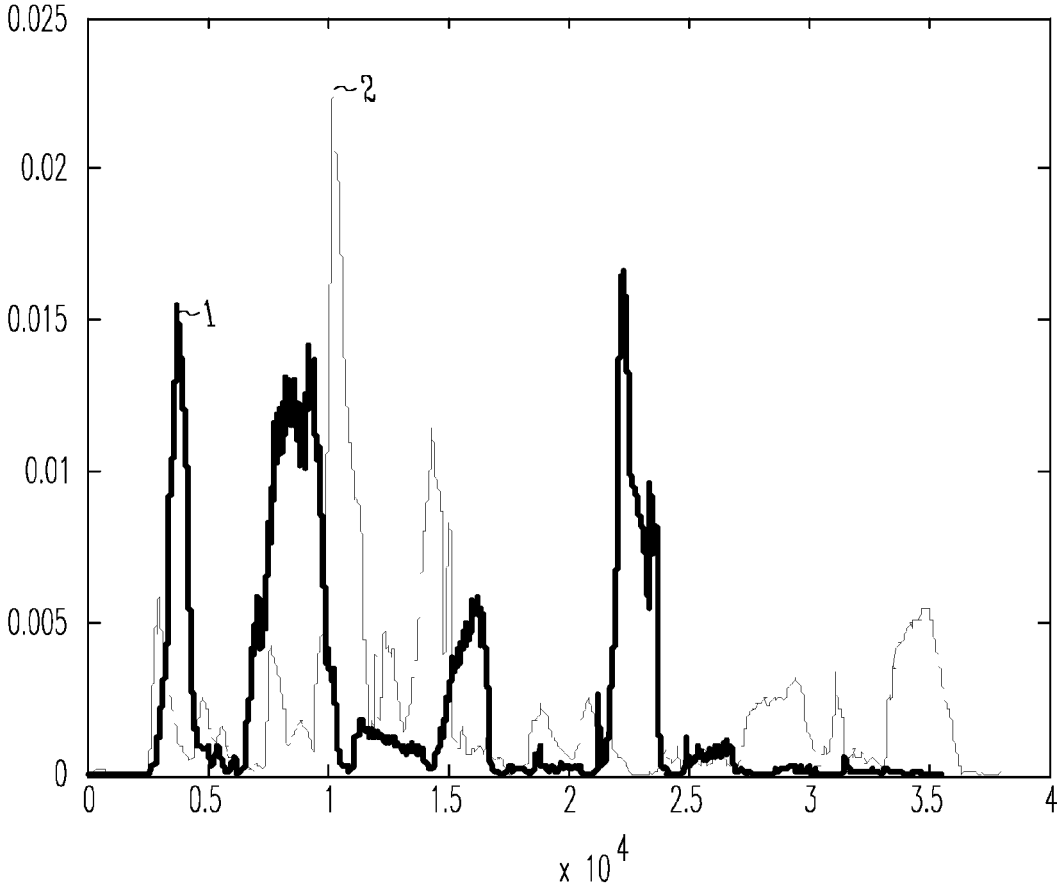
FIG. 1 shows the levels of two different sounds out of a filter centered at 1 kHz.
Figure 2:
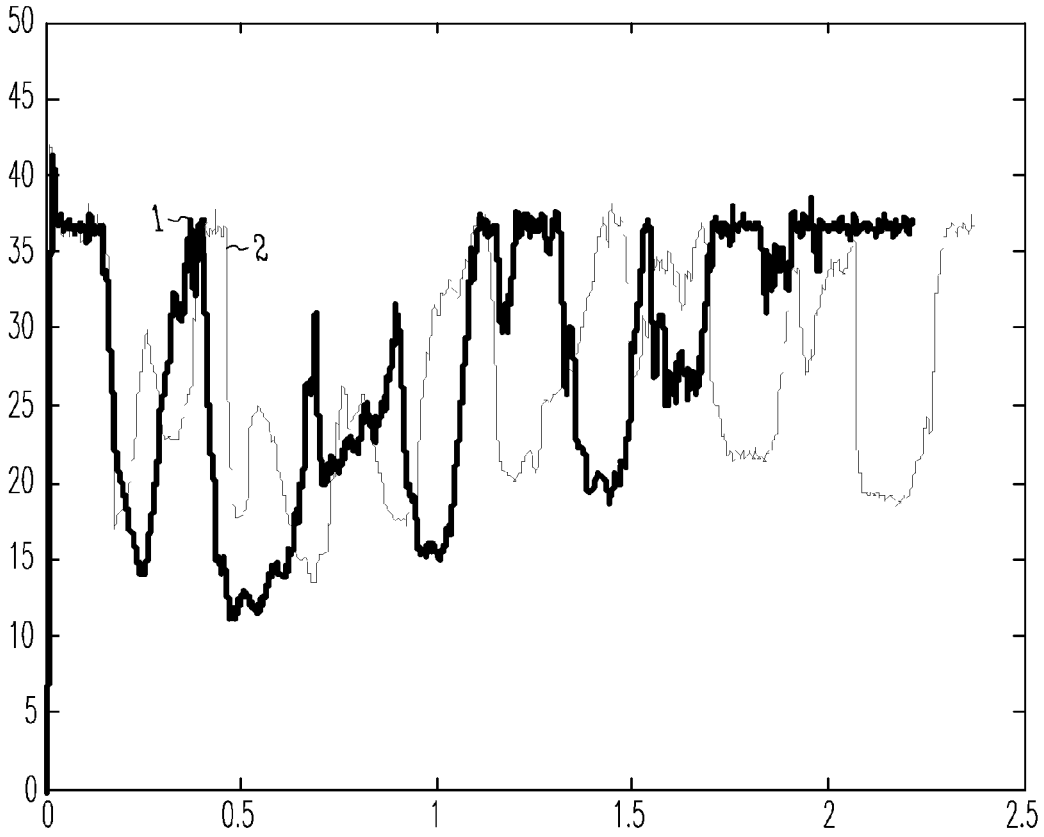
FIG. 2 shows the gains that would be applied to those two different sounds of FIG. 1 at 1 kHz if they were to be presented to a hypothetical multiband dynamic range compressor.
Figure 3:
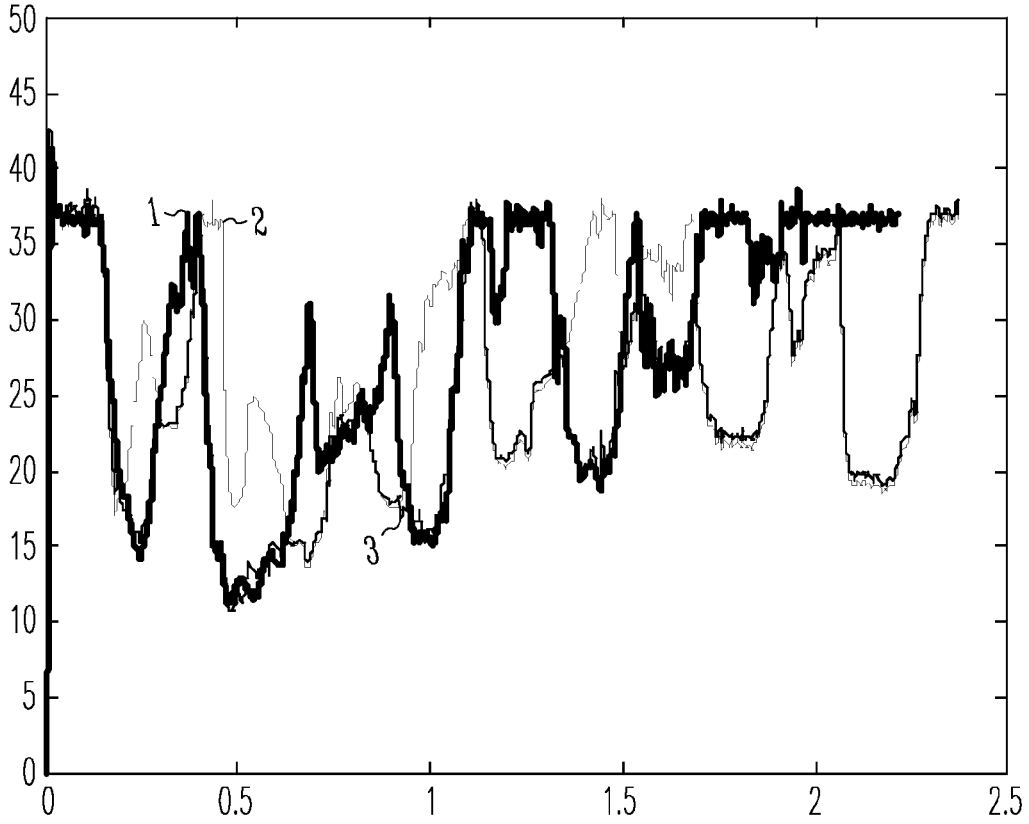
FIG. 3 shows the two gains from FIG. 1 represented by the thick line and the thinner line, but with a line of intermediate thickness which shows the gain that is applied when the two sounds are mixed together before being sent to the multiband compressor.
Figure 4:
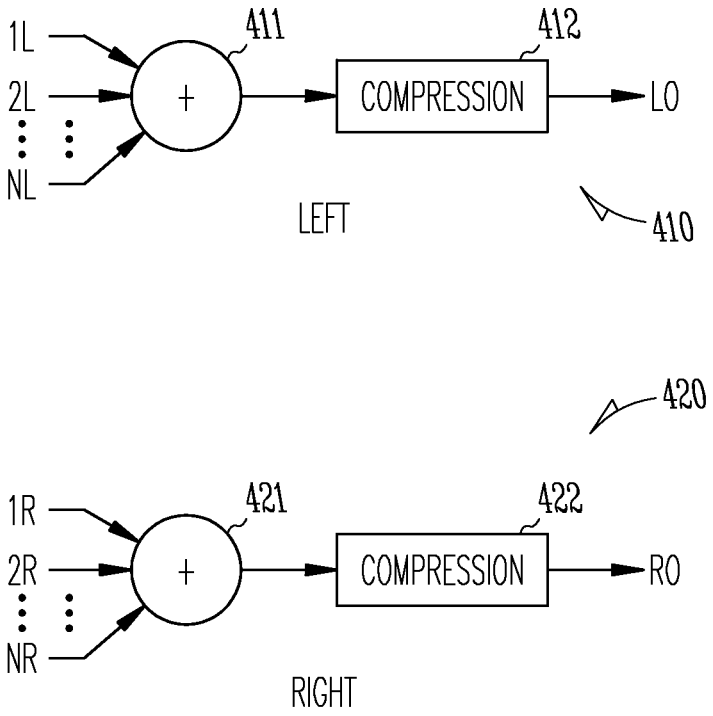
FIG. 4 illustrates a system for processing left and right stereo signals from a plurality of sound sources in order to produce mixed left and right sound output signals that can be used by left and right hearing assistance devices.

FIG. 4 illustrates a system for processing left and right stereo signals from a plurality of sound sources in order to produce mixed left and right sound output signals that can be used by left and right hearing assistance devices. The figure shows separate left 410 and right 420 channels where a plurality of left sound sources 1L, 2L, . . . , NL are mixed by mixer 411 to make a composite signal that is compressed using compressor 412 to produce the left output signal LO. FIG. 4 also shows in the right channel 420 a plurality of right sound sources 1R, 2R, . . . , NR that are mixed by mixer 421 to make a composite right signal that is compressed by compressor 422 to produce a right signal RO. It is understood that the separate sound sources can be right and left tracks of individual instruments. It is also possible that the tracks include vocals or other sounds. The system provides compression after the mixing which can result in over-attenuation of desired sounds, which is an undesired side effect of the signal processing. For example, if track 1 included bass guitar and track 2 included a lead guitar, it is possible that the louder instrument would dominate the signal strength in the channel at any given time and may result in over-attenuation of the weaker signal when compression is applied to the composite signal. Furthermore, because left and right signals are compressed independently, level difference between the left and right output signals LO and RO are compressed, i.e., ILD cues are reduced.

Figure 5:
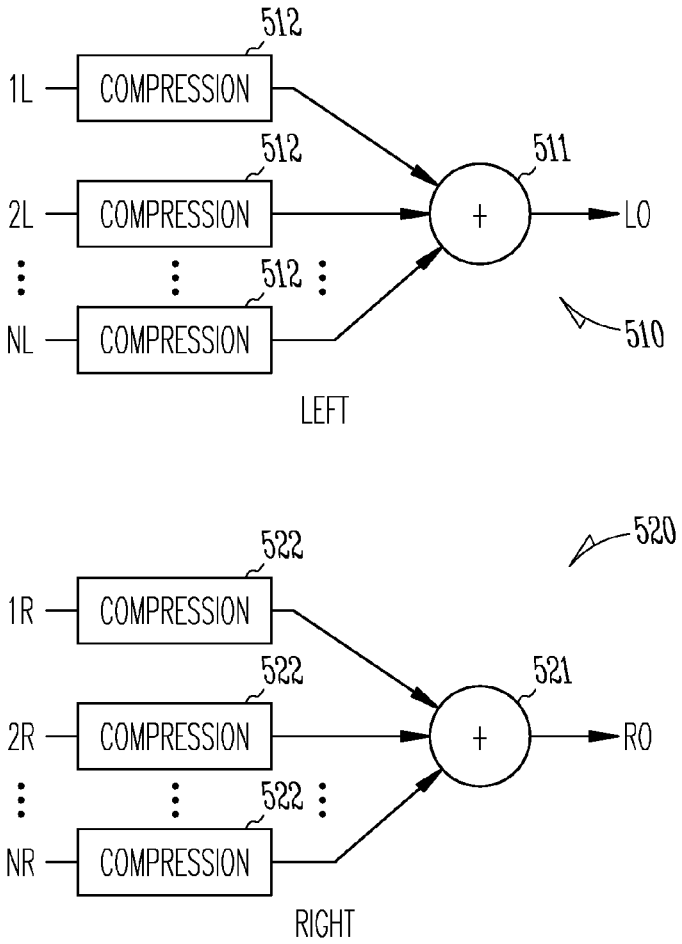
FIG. 5 illustrates a system for processing left and right stereo signals from a plurality of sound sources by applying compression before mixing to produce mixed left and right sound output signals that can be used by left and right hearing assistance devices according to one embodiment of the present subject matter.

FIG. 5 illustrates a system for processing left and right stereo signals from a plurality of sound sources by applying compression before mixing to produce mixed left and right sound output signals that can be used by left and right hearing assistance devices, according to one embodiment of the present subject matter. This embodiment applies compression (512 for the left channel 510 and 522 for the right channel 520) to each signal independently to assist in preserving the ability to mix each signal accordingly (using mixers 510 and 521, respectively). This approach allows each sound source 1L, 2L, . . . , NL and 1R, 2R, . . . , NL to be added to the composite signal as desired. It is understood that to provide a plurality of sound sources two or more sound sources are input into the mixer. These may be right and left components of an instrumental input, vocal input, or other sound input. Level difference between the left and right output signals LO and RO are compressed, i.e., ILD cues are reduced, because left and right signals are compressed independently.

Figure 6:
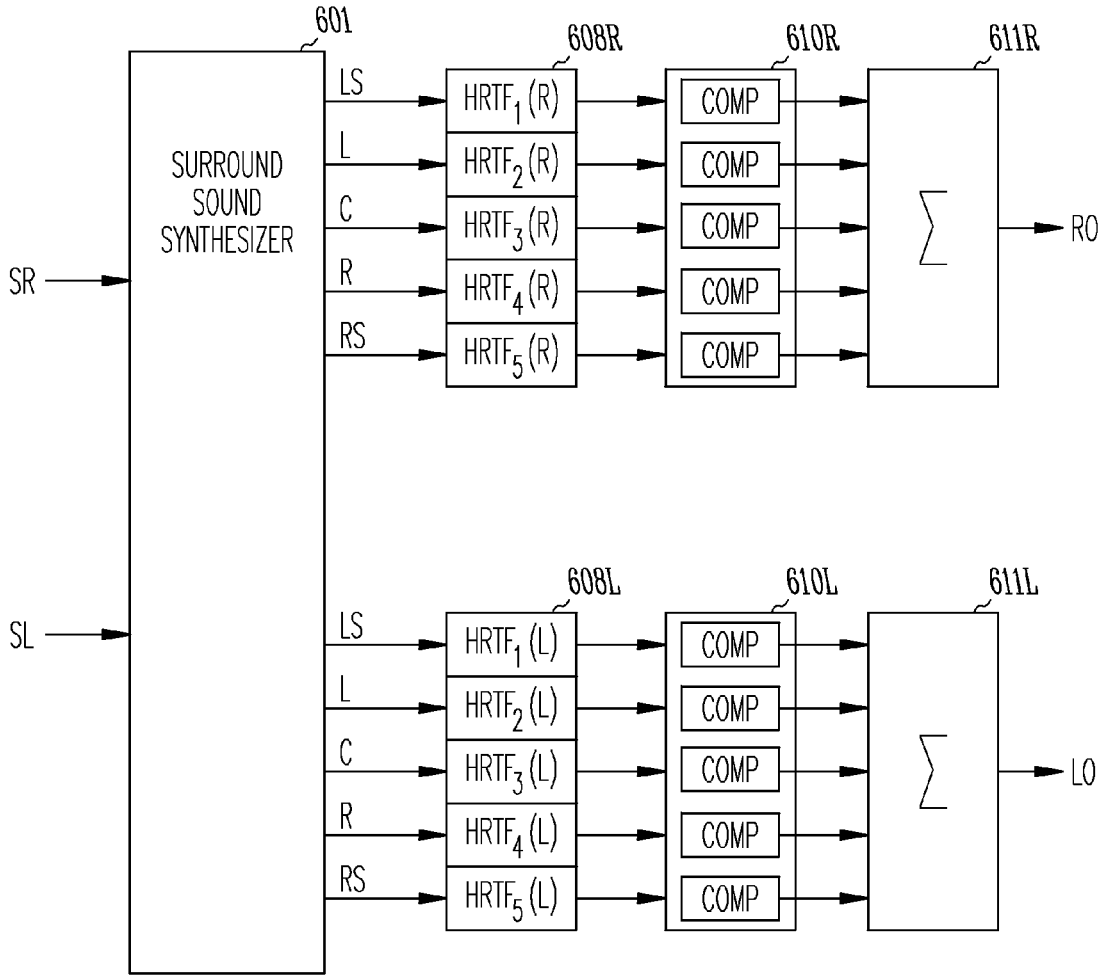
FIG. 6 shows one embodiment of a signal processor that includes a surround sound synthesizer for producing the surround sound signals from the left and right stereo signals where compression is applied the surround sound signals before mixing to produce mixed left and right sound output signals that can be used by left and right hearing assistance devices according to one embodiment of the present subject matter.

FIG. 6 shows one embodiment of a signal processor that includes a surround sound synthesizer for producing the surround sound signals from the left and right stereo signals where compression is applied the surround sound signals before mixing to produce mixed left and right sound output signals that can be used by left and right hearing assistance devices according to one embodiment of the present subject matter. A surround sound synthesizer 601 receives a right stereo signal SR and a left stereo signal SL and converts the signals into LS, L, C, R, and RS signals. In various embodiments, the HRTFs are not used and the signal passes from the surround sound synthesizer 601 to the compression stages 610R and 610L before being sent to the mixers 611R and 611L. In various embodiments, the signals are processed by right and left head-related transfer functions (HRTFs) 608R and 608L. The resulting signals are then sent through compression stages 610R and 610L before being sent through mixers 611R and 611L. The resulting outputs RO and LO are used by the hearing assistance device to provide stereo sound reception. Level difference between the left and right output signals LO and RO are compressed, i.e., ILD cues are reduced, because left and right signals are compressed independently. It is understood that other surround sound systems may be employed without departing from the scope of the present subject matter. For example, surround sound systems include, but are not limited to Dolby 5.1, 6.1, and 7.1 systems, and the application of HRTFs is optional. Thus, the examples provided herein are intended to be demonstrative and not limiting, exclusive, or exhaustive.

One advantage of the system of FIG. 6 is that the center channel, which frequently is dominated by vocals, can be separated compressed from the other channels, which are largely dominated by the music. Such compression and mixing avoids cross modulation of gain. In various embodiments, the level of compression is commensurate with that found in hearing assistance devices, such as hearing aids. Other levels of compression are possible without departing from the scope of the present subject matter.

Independent dynamic-range compression of stereo signals diminishes ILD cues for localization. Particularly in complex situations with multiple sources, preserving ILD cues is beneficial. The present subject matter preserves source-specific ILD cues by preventing compression and cross modulation of the ILDs, while providing optimal gain for each individual source.

Figure 9A:
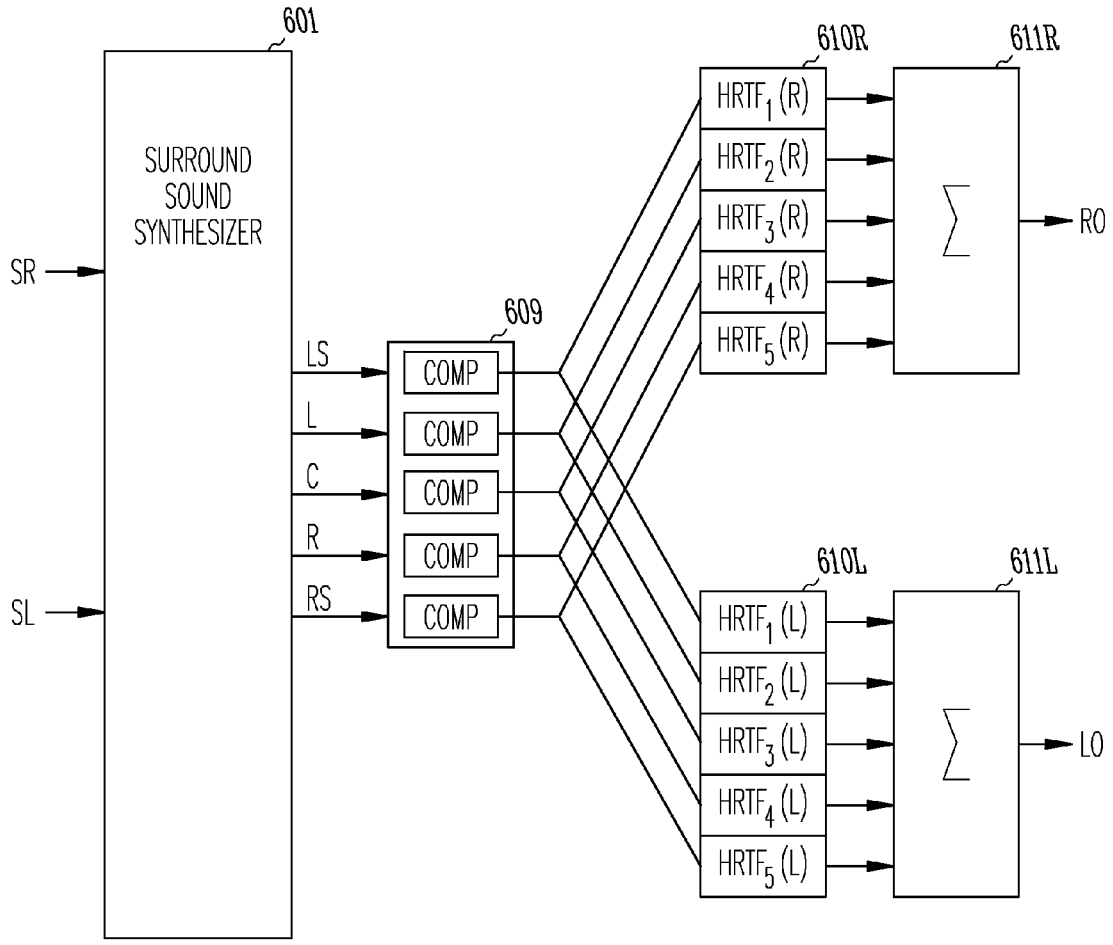
FIG. 9A shows a modification of FIG. 6 above, including independently compressing individual sound sources before applying HRTFs to prevent compression and cross modulation of ILDs, according to one embodiment of the present subject matter.

FIG. 9A shows a modification of FIG. 6 above, including independently compressing individual sound sources before applying HRTFs to prevent compression and cross modulation of ILDs, according to one embodiment of the present subject matter. The present subject matter applies compression 609 separately to each individual source in a mixture, without compressing its ILD. The five surround sound signals LS, L, C, R, and RS represent estimates of individual source signals. These estimated source signals are first independently compressed which prevents cross modulation between the waveforms of these sources. Then, head-related transfer functions (HRTFs) are applied to the compressed source signals. Since the HRTFs are applied after compression, the ILDs are neither compressed nor cross modulated.

Figure 9B:
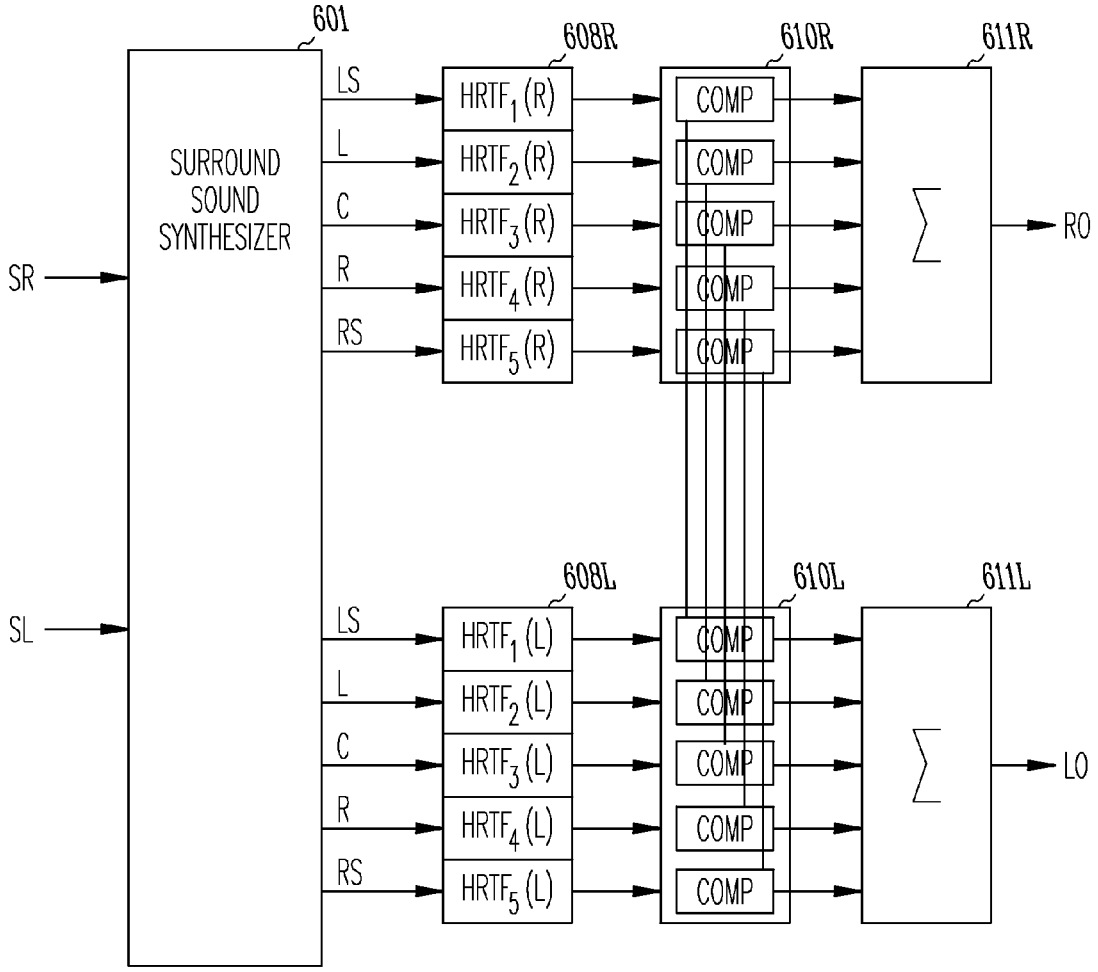
FIG. 9B shows a modification of FIG. 6 above, including applying coordinated compression to individual left and right signal sources after applying HRTFs to prevent compression and cross modulation of ILDs, according to one embodiment of the present subject matter.

An alternate embodiment is shown in FIG. 9B including applying coordinated compression to individual left and right signal sources after applying HRTFs to prevent compression and cross modulation of ILDs, according to one embodiment of the present subject matter. Here, coordinated compression, i.e., identical gain, is applied to the left and right individual source signals after application of the HRTFs. Coordinated compression prevents compression and cross modulation of the ILDs. This holds true for simple coordinated compression of the mixture as well. However, here optimal gain is applied to each individual source. High-level sources, for example, will not suppress the gain for low-level sources.

Figure 7:
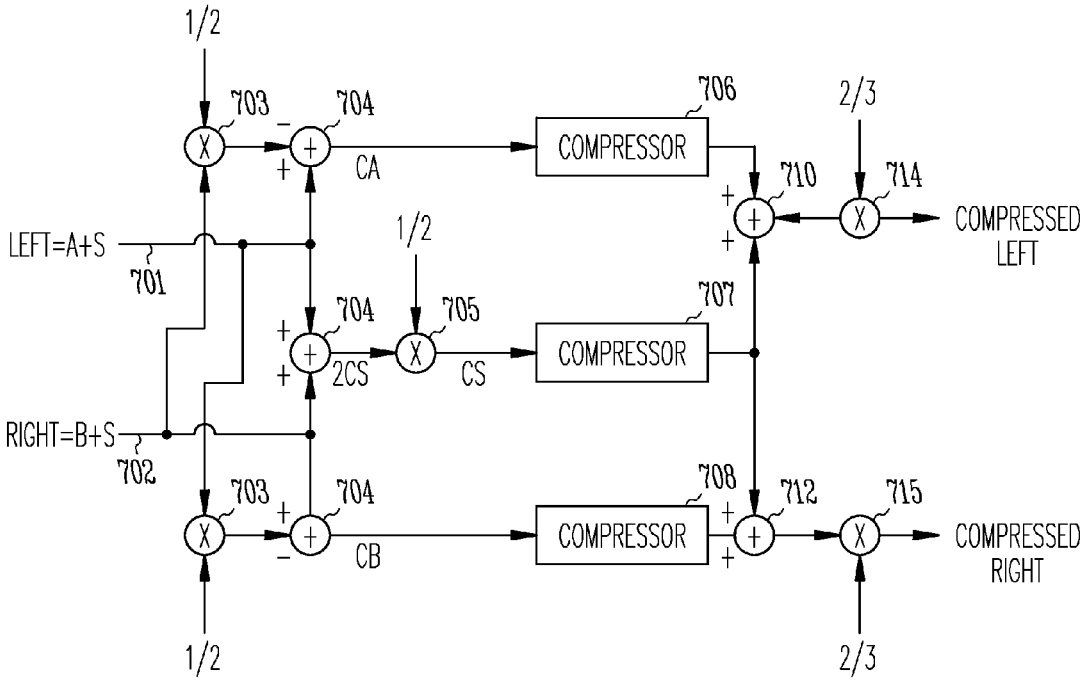
FIG. 7 shows an embodiment where a stereo music signal is processed to separate the center signal from the left-dominant and right-dominant signals in order to compress the center signal separately from the left-dominant and right-dominant signals, according to one embodiment of the present subject matter.
Figure 10:
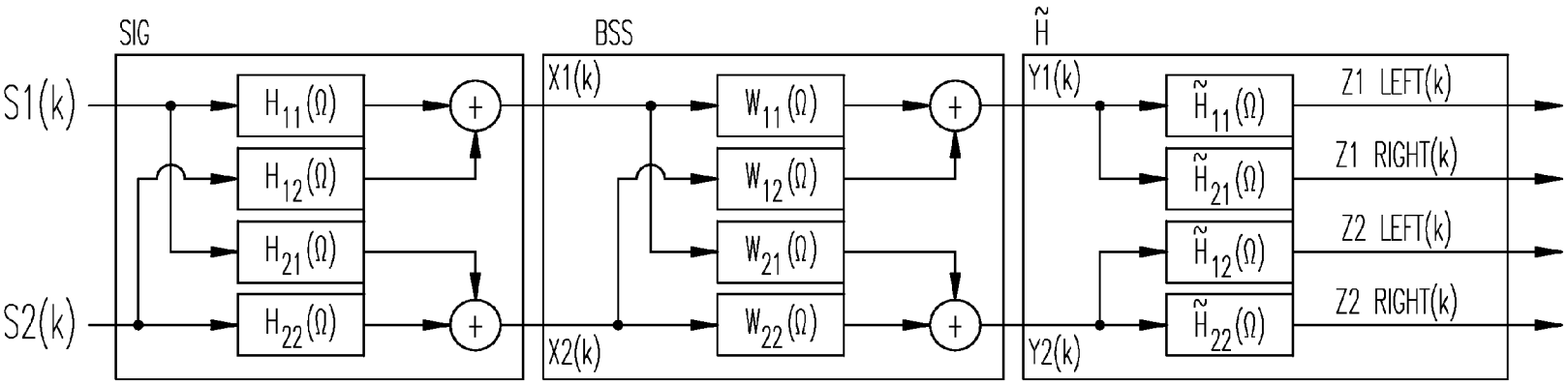
Fig. 10 (Prior Art)
FIG. 10 shows a system with separate source signals and separate microphone signals.
Figure 11A:
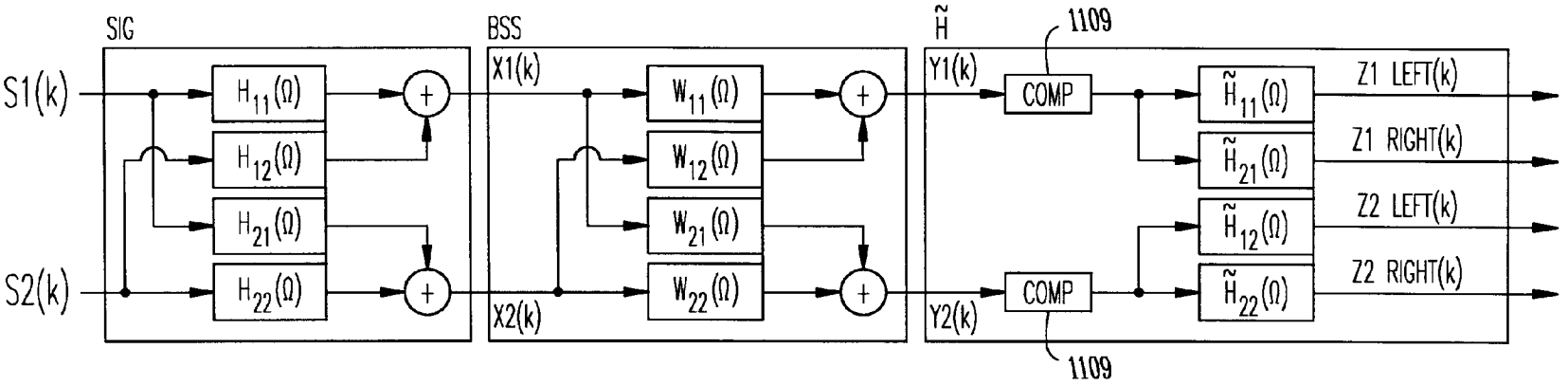
FIG. 11A shows a modification of FIG. 10 above, including independently compressing estimated source signals before applying HRTFs to prevent compression and cross modulation of ILDs, according to one embodiment of the present subject matter.
Figure 11B:
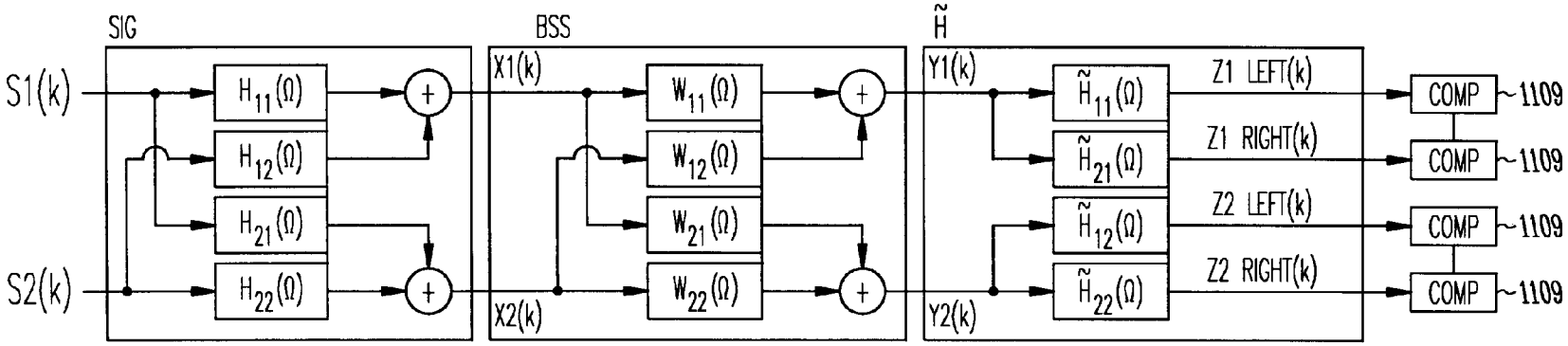
FIG. 11B shows a modification of FIG. 10 above, including applying coordinated compression to individual left and right signal sources after applying HRTFs to prevent compression and cross modulation of ILDs, according to one embodiment of the present subject matter.

FIG. 10 shows a system with separate source signals and separate microphone signals. Here, s1 and s2 represent the true separate source signals and x1 and x2 two (hearing-aid) microphone signals. Blind source separation (BSS) provides the estimates y1 and y2 of these source signals. Application of the (room) transfer functions $H_{nm}$tilde yields separate stereo output signals for the two sources. Signals "z1 left" and "zl right," for example, represent the estimated left and right microphone signals for the single source s1. FIG. 11A shows a modification of FIG. 10 above, representing one embodiment of the present subject matter. Compression 1109 is applied separately to the estimated source signals y1 and y2, before application of the transfer functions $H_{nm}$tilde. Similar to the embodiment in FIG. 9A, this yields ILDs that are neither compressed nor cross modulated. The embodiment shown in FIG. 11B applies coordinated compression 1109 to the stereo source signals, similar to the embodiment in FIG. 9B. Again, ILDs are preserved while optimal gain is applied to each of the sources. FIG. 7 shows one embodiment for separating a stereo signal into three channels for a more source-specific compression. Often in music, the signal for the singer is equally applied to both the left and right channel, centering the perceptual image of the singer. Consider the simple example of a stereo music signal with a singer S that is equally in the left and right channel, instrument A that is predominantly in the left channel, and instrument B that is predominantly in the right channel. Then, the left L and right R channels can be described as:

$$L=A+S$$

$$R=B+S$$

Then, one can remove the singer from the instruments by subtracting the left from the right channels, and create a signal that is dominated by the singer by adding the left and right channels:

$$L-R=(A+S)-(B+S)=A-B$$

$$L+R=(A+S)+(B+S)=A+B+2*S$$

$$CS=(L+R)/2=S+(A+B)/2$$

Thus, one can compress the (L+R)/2 mix to the compressor so that the gain is primarily that for the singer. To get a signal that is primarily instrument A and one that is primarily instrument B:

$$CA=L-R/2=(A+S)-(B+S)/2=A-(B-S)/2$$

$$CB=R-L/2=(B+S)-(A+S)/2=B-(A-S)/2$$

After CS, CL and CR have been individually compressed, they are mixed together to create a stereo channel again:

$$CL=2*(CS+CA)/3$$

$$CR=2*(CS+CB)/3$$

FIG. 7 is one example of how to combine the original channels before compression and how to mix the post-compressed signals back into a stereo signal, but other approaches exist. FIG. 7 shows the left (A+S) signal 701 and the right (B+S) signal 702 applied to multipliers (which multiply by ½) and summed by summers to create the CA, CB, and 2CS signals. The CS signal is obtained using multiplier 705. The CA, CB and CS signals are compressed by compressors 706, 708, and 707, respectively, and summed by summers 710 and 712. The resulting outputs are multiplied by ⅔ by multipliers 714 and 715 to provide the compressed left and compressed right signals, as shown in FIG. 7. It is understood that this is one example of how to process the signals and that other variations are possible without departing from the scope of the present subject matter. Thus, the system set forth in FIG. 7 is intended to be demonstrative and not exhaustive or exclusive.

Figure 8:
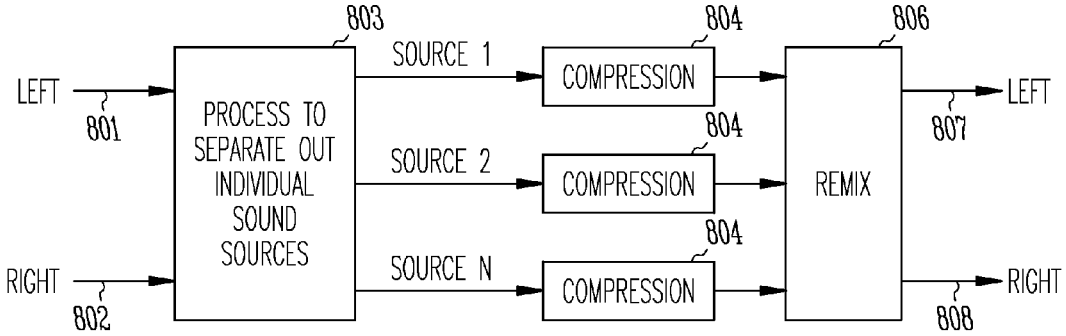
FIG. 8 shows an embodiment for separating sounds into component sound sources and compressing each individual sound source before being remixed into the original number of channels, according to one embodiment of the present subject matter.

FIG. 8 represents a general way of isolating a stereo signal into individual components that can then be separately compressed and recombined to create a stereo signal. There are known ways of taking a stereo signal and extracting the center channel in a more complex way than shown in FIG. 8 (e.g., U.S. Pat. No. 6,405,163, and U.S. Patent Application Publication Number 2007/0076902). Techniques can also be applied to monaural signals to separate the signal into individual instruments. With either approach, the sounds are separated into individual sound source signals, and each source is compressed; the individually compressed sources are then combined to create either the monaural or stereo signal for listening by the hearing impaired listener.

Left stereo signal 801 and right stereo signal 802 are sent through a process 803 that separates individual sound sources. Each source is sent to a compressor 804 and then mixed with mixer 806 to provide left 807 and right 808 stereo signals according to one embodiment of the present subject matter.

It is understood that the present subject matter can be embodied in a number of different applications. In applications involving mixing of music to generate hearing assistance device-compatible stereo signals, the mixing can be performed in a computer programmed to mix the tracks and perform compression as set forth herein. In various embodiments, the mixing is done in a fitting system. Such fitting systems include, but are not limited to, the fitting systems set forth in U.S. patent application Ser. No. 11/935,935, filed Nov. 6, 2007, and entitled: SIMULATED SURROUND SOUND HEARING AID FITTING SYSTEM, the entire specification of which is hereby incorporated by reference in its entirety.

In various embodiments, the mixing is done using the processor of the hearing assistance device. In cases where such devices are hearing aids, that processing can be done by the digital signal processor of the hearing aid or by another set of logic programmed to perform the mixing function provided herein. Other applications and processes are possible without departing from the scope of the present subject matter.

It is understood that in various embodiments, the apparatus and processes set forth herein may be embodied in digital hardware, analog hardware, and/or combinations thereof. It is also understood that in various embodiments, the apparatus and processes set forth herein may be embodied in hardware, software, firmware, and/or combinations thereof.

This application is intended to cover adaptations and variations of the present subject matter. It is to be understood that the above description is intended to be illustrative, and not restrictive. The scope of the present subject matter should be determined with reference to the appended claim, along with the full scope of legal equivalents to which the claims are entitled.

What is claimed is:

1. An apparatus for processing sound for a hearing assistance device placed at a wearer's ear, the apparatus comprising:

a receiver adapted to receive signals from a sound environment;

a processor connected to the receiver, the processor adapted to process received signals to isolate individual sound source components, the processor further adapted to apply a head-related transfer function to the individual sound source components;

a compressor connected to the processor, the compressor adapted to independently compress each of the individual sound source components prior to the application of the head-related transfer function;

a mixer connected to the compressor, the mixer adapted to mix the compressed sound source components to produce a mixed output signal; and a speaker connected to the mixer, the speaker integrated with the hearing assistance device and adapted to output the mixed output signal at the wearer's ear.

2. The apparatus of claim 1, wherein the compressor is adapted to apply coordinated compression to the individual sound components after application of the head-related transfer function.

3. The apparatus of claim 1, wherein the head related transfer function is applied at an individual angle of reception for each of the individual sound components.

4. The apparatus of claim 1, wherein the receiver is adapted to receive sound signals having a stereo right (SR) and a stereo left (SL) sound signal.

5. The apparatus of claim 4, wherein the processor is adapted to process the SR and SL signals to produce left surround (LS), left (L), center (C), right (R) and right surround (RS) signals.

6. The apparatus of claim 5, wherein the processor is further adapted to generate a processed version for each of the LS, L, C, R, and RS signals by application of a head-related transfer function at an individual angle of reception for each of the LS, L, C, R, and RS signals.

7. The apparatus of claim 6, wherein the compressor is adapted to compress the processed version for each of the LS, L, C, R, and RS signals.

8. The apparatus of claim 7, wherein the mixer is adapted to mix the compressed and processed version of the LS, L, C, R, and RS signals to produce one or both of a right output signal (RO) and a left output signal (LO).

9. The apparatus of claim 8, wherein the hearing assistance device includes a right hearing assistance device including a right speaker and a left hearing assistance device including a left speaker, and wherein the RO signal is adapted to be used by the right speaker the LO signal is adapted to be used by the left speaker.

10. The apparatus of claim 1, wherein the processor includes a synthesizer.

11. The apparatus of claim 10, wherein the synthesizer includes a surround sound synthesizer.

12. A method, comprising:

receiving stereo surround signals from a sound environment;

processing the received signals to isolate individual sound source components;

independently compressing the individual sound source components to prevent cross modulation between waveforms of the source components; and after compressing the components, applying a head-related transfer function to the compressed individual sound source components.

13. The method of claim 12, wherein receiving stereo surround signals includes receiving at least one left sound signal and at least one right sound signal.

14. The method of claim 12, wherein processing the received signals to isolate components includes processing to isolate voice and instrument components from musical signals.

15. The method of claim 12, wherein applying the head related transfer function includes applying the transfer function at an individual angle of reception for each of the individual sound components.

16. A method, comprising:

receiving stereo surround signals from a sound environment;

processing the received signals to isolate individual sound source components;

applying a head-related transfer function to the compressed individual sound source components; and after applying the head-related transfer function, compressing the individual sound source components using coordinated compression to prevent compression and cross modulation of ILD cues for localization.

17. The method of claim 16, wherein applying the head related transfer function includes applying the transfer function at an individual angle of reception for each of the individual sound components.

18. The method of claim 16, further comprising mixing the compressed sound source components to produce a mixed left output signal and a mixed right output signal.

19. The method of claim 18, wherein mixing the signals is performed by a processor of the hearing assistance device.

20. The method of claim 18, wherein mixing the signals is performed by a fitting system adapted to communicate with the hearing assistance device.

* * * * *